US008250998B2

(12) United States Patent
Kawaguchi et al.

(10) Patent No.: US 8,250,998 B2
(45) Date of Patent: Aug. 28, 2012

(54) SEWING MACHINE PROVIDED WITH AUXILIARY TABLE

(75) Inventors: Yasuhiko Kawaguchi, Nagoya (JP); Junnosuke Matsuda, Nagoya (JP); Takahira Osamura, Kitanagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 109 days.

(21) Appl. No.: 12/871,301

(22) Filed: Aug. 30, 2010

(65) Prior Publication Data

US 2011/0048302 A1 Mar. 3, 2011

(30) Foreign Application Priority Data

Sep. 3, 2009 (JP) ..... 2009-203572

(51) Int. Cl.
*A47B 29/00* (2006.01)

(52) U.S. Cl. ..... 112/217.1

(58) Field of Classification Search ..... 112/217.1, 112/103, 136, 217.2, 470.13, 470.14, 470.18, 112/102.5, 101
See application file for complete search history.

(56) References Cited

U.S. PATENT DOCUMENTS

| | | | | |
|---|---|---|---|---|
| 2,305,343 | A * | 12/1942 | Gadbois | 112/217.1 |
| 3,561,383 | A * | 2/1971 | Fresard | 112/217.1 |
| 3,995,573 | A * | 12/1976 | Nishigami et al. | 112/258 |
| 6,293,212 | B1 * | 9/2001 | Ebata et al. | 112/103 |

FOREIGN PATENT DOCUMENTS

| | | |
|---|---|---|
| JP | U 58-112290 | 8/1983 |
| JP | U 60-155486 | 10/1985 |
| JP | A 6-126073 | 5/1994 |
| JP | A 6-312080 | 11/1994 |

* cited by examiner

*Primary Examiner* — Tejash Patel
(74) *Attorney, Agent, or Firm* — Oliff & Berridge, PLC

(57) ABSTRACT

A sewing machine includes a sewing machine bed, an auxiliary table detachably attachable to the bed, a guide member guiding the table between a first position where the table is held in parallel to an upper surface of bed and a second position where the table is detachably attached to the bed, and an engaging member mounted on the table so as to engaging the guide member. The guide member and the engaging member are engaged with each other, so that a tilt of the table to the upper surface of bed is limited within a predetermined angular range when the table is positioned between the first and second positions. The guide member has a bearing portion and a side plate having a groove guiding the engaging member from the first to second positions. The engaging member has a sliding contact portion brought into sliding contact with the bearing portion.

8 Claims, 12 Drawing Sheets

SEWING MACHINE PROVIDED WITH AUXILIARY TABLE

CROSS-REFERENCE TO RELATED APPLICATIONS

This application is based on and claims the benefit of priority from the prior Japanese Patent Application No. 2009-203572, filed on Sep. 3, 2009, the entire contents of which are incorporated herein by reference.

BACKGROUND

1. Field

The present disclosure relates to a sewing machine provided with an auxiliary table which is detachably attachable to a sewing machine bed.

2. Related Art

There have conventionally been known sewing machines provided with an auxiliary table having a plane that is substantially on a level with an upper surface of a sewing machine bed. For example, a conventional auxiliary table device comprises a band-shaped plate mounted on a side of the sewing machine bed and an auxiliary bed which is detachably attachable to the band-shaped plate. A support is pivotally mounted on the auxiliary bed so as to be movable along the band-shaped plate. After the pivotal support of the auxiliary table has been engaged with the band-shaped plate, the auxiliary support is moved relative to the sewing machine bed so as to be attached to the bed. In this case, the auxiliary bed pivots about a pivoting axis of the pivotal support. The auxiliary bed is inclined when moved relative to the sewing machine bed thereby to be attached to and detached from the bed. As a result, there is a possibility that the auxiliary bed may collide against components such as needle bars disposed below a head of the sewing arm, sewing machine needles attached to the respective needle bars and presser bars.

SUMMARY

Therefore, an object of the present disclosure is to provide a sewing machine which can prevent the auxiliary table from collision against the components disposed in the head and in which the auxiliary table can easily be attached and detached.

The present disclosure provides a sewing machine comprising a sewing machine bed having an upper surface; a generally flat-plate-shaped auxiliary table which is detachably attachable to the sewing machine bed; a guide member which is provided on the sewing machine bed and guides the auxiliary table between a first position which is set at a rear side of the sewing machine bed and where the auxiliary table is held in parallel to the upper surface of the sewing machine bed and a second position which is set at a front side of the sewing machine bed and where the auxiliary table is attached to and detached from the sewing machine bed; and an engaging member which is provided on the auxiliary table so as to movably engage the guide member, wherein the guide member and the engaging member are engaged with each other, whereby a tilt of the auxiliary table to the upper surface of the sewing machine bed is limited within a predetermined angular range when the auxiliary table is positioned between the first and second positions, the guide member has a generally flat-plate-shaped bearing portion which is provided in parallel to the upper surface of the sewing machine bed and extends from the first position to the second position; a side plate which extends below the bearing portion in a front-back direction and has a groove guiding the engaging member from the first position to the second position; and the engaging member has a sliding contact portion which is brought into sliding contact with the bearing portion and a protrusion which is inserted into the groove.

DETAILED DESCRIPTION

Figure 1:
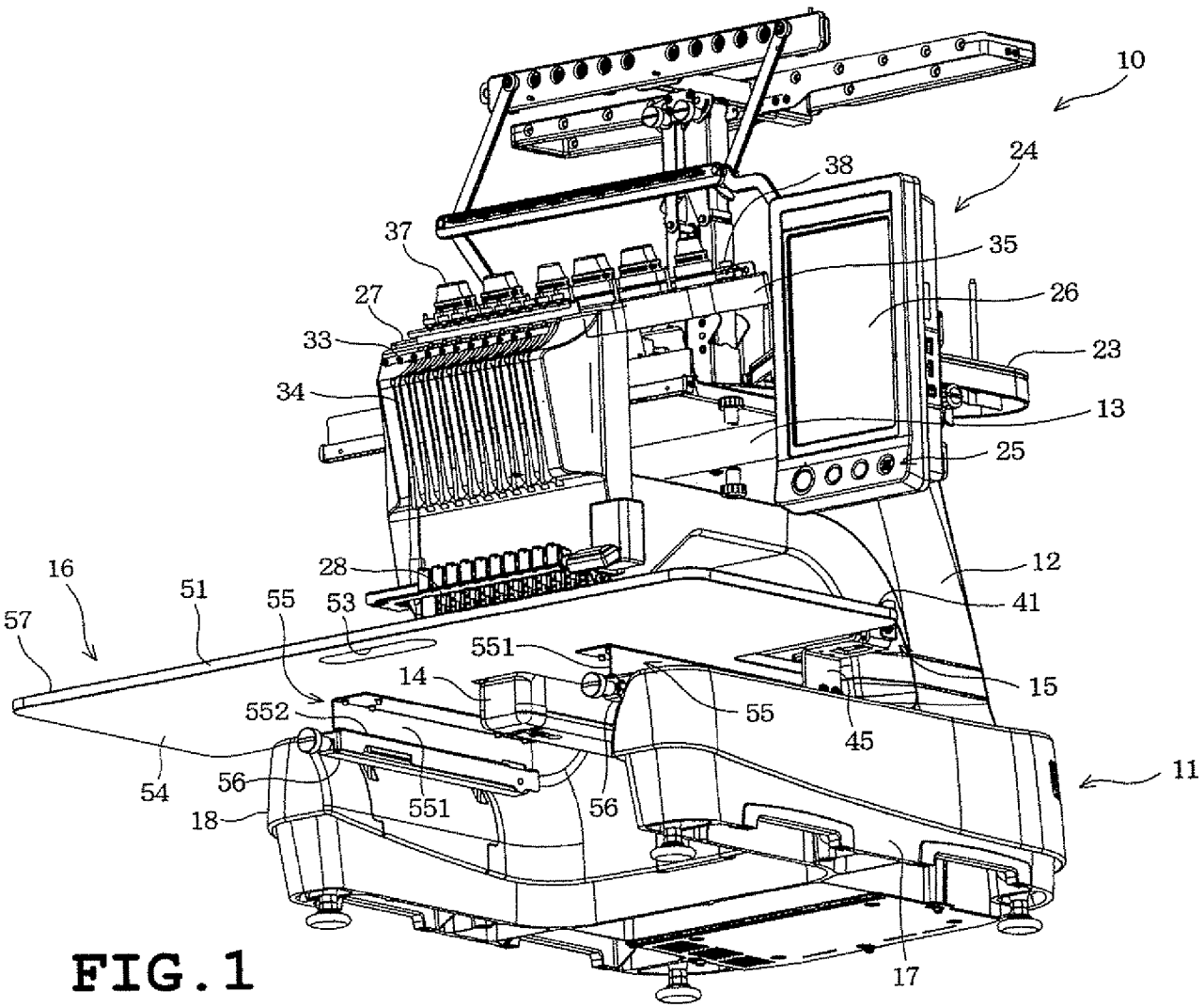
FIG. 1 is a perspective view of the sewing machine in accordance with a first embodiment as viewed from below.

Two embodiments will be described with reference to the accompanying drawings. Identical or similar parts are labeled by the same reference numerals throughout the embodiments. In each embodiment, the term "parallel" or "vertical" does not always mean "0°" or "90°" but includes a state of substantially "parallel" or "vertical."

Figure 2:
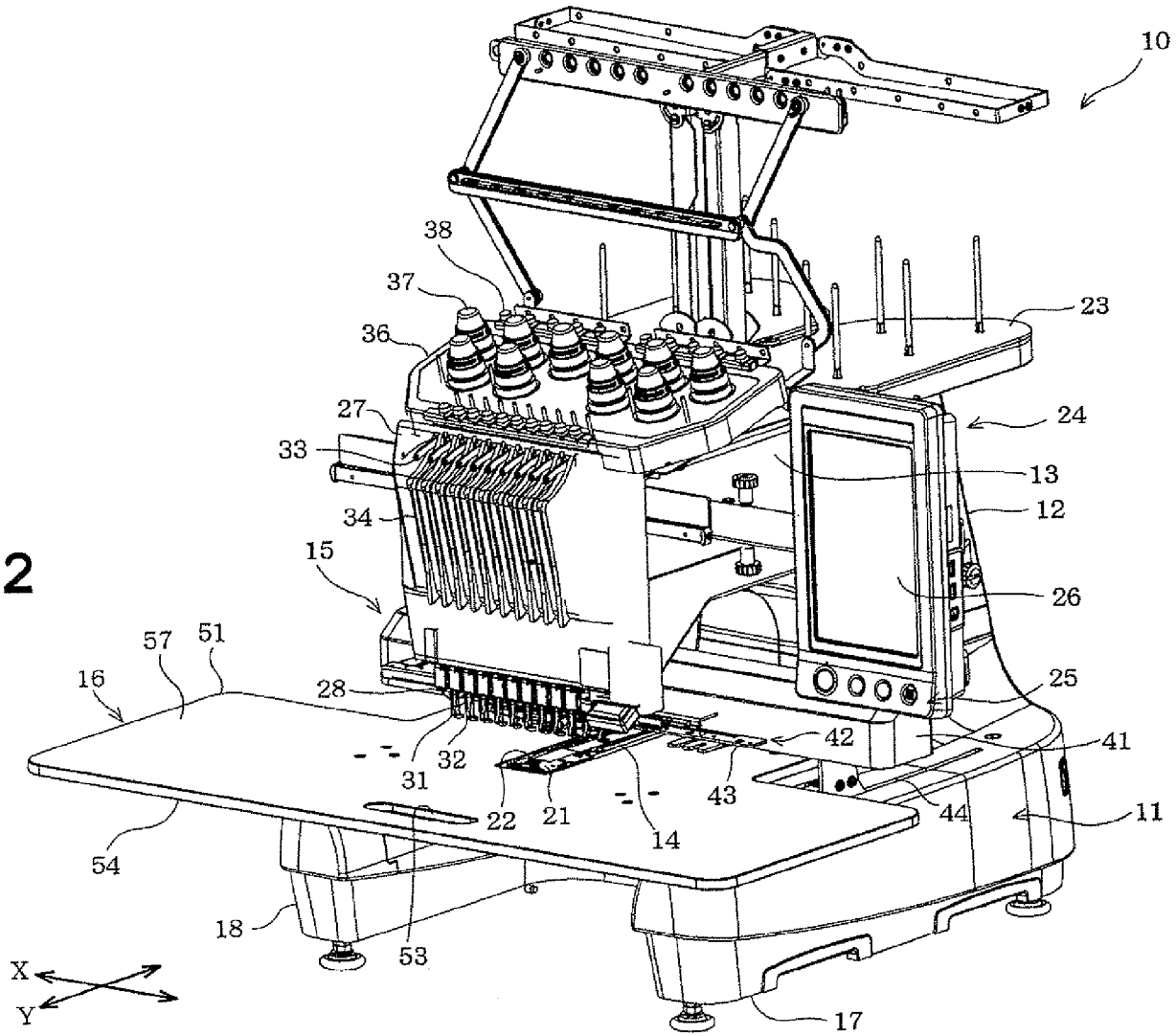
FIG. 2 is a perspective view of the sewing machine as viewed from above.

A first embodiment will now be described with reference to FIGS. 1 and 2. A sewing machine 10 as shown in FIGS. 1 and 2 is a multineedle embroidery sewing machine which can sew embroidery. In the following description, the right-left direction of the sewing machine 10 is referred to as "X direction" and the front-back direction thereof is referred to as "Y direction" (see FIG. 2).

The sewing machine 10 comprises a sewing machine bed 11 (hereinafter referred to as "sewing bed"), a vertical support pillar 12, a horizontal arm 13, a transfer mechanism 15 and an auxiliary table 16. The sewing bed 11 is installed on an installation mounting (not shown). The support pillar 12 extends upward from a rear end of the sewing bed 11 and has two or right and left legs 17 and 18 both extending frontward. The sewing bed 11 thus has a front formed into an open inverted U-shape as viewed from above.

The sewing bed 11 includes a cylinder bed 14 extending frontward from a horizontally middle part of the bed. The cylinder bed 14 is formed integrally with the sewing bed 11 and has a needle plate 21 which is formed in an upper part thereof at the front end side and has a needle hole 22. The cylinder bed 14 accommodates a thread capturing hook, a thread cutting mechanism and a hook member such as a picker in a front end side interior thereof. The cylinder bed 14 serves as a free arm portion.

Figure 3:
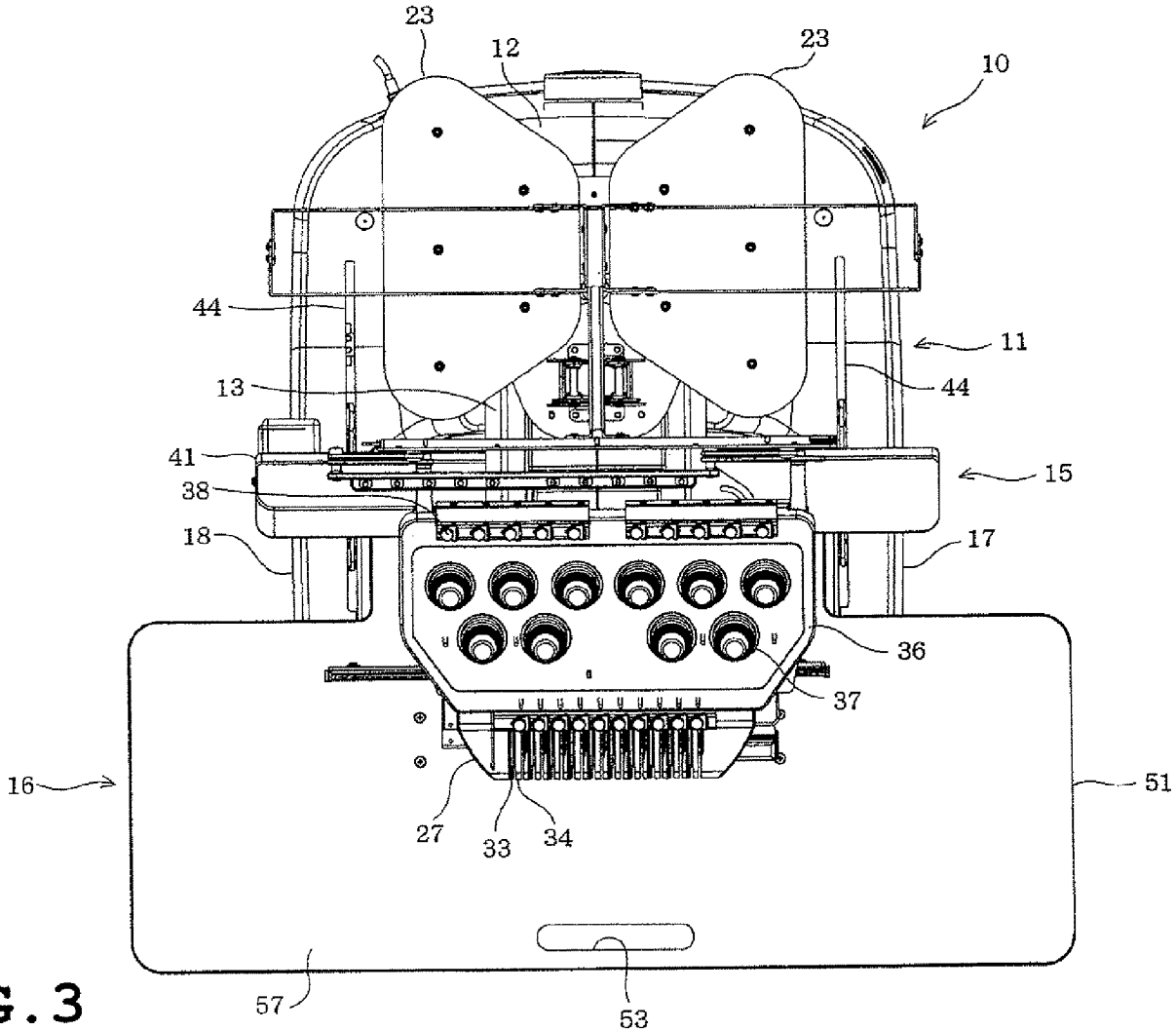
FIG. 3 is a plan view of the sewing machine.

The arm 13 is provided with a spool stand 23 located above the rear end side thereof. A plurality of thread spools (not shown) is mounted on the spool stand 23. Furthermore, an operation panel 24 is mounted on the right part of the arm 13 and has operation switches 25 and a liquid-crystal display 26. The operation switches 25 accept various instructions, selection and input operations by the operator. The liquid-crystal display 26 displays messages or the like necessary for the operator. The operation panel 24 is eliminated in FIG. 3.

The arm 13 has a needle-bar case 27 which is formed on a distal end thereof so as to be movable in the X-direction or in the horizontal direction. A plurality of needle bars 28 horizontally juxtaposed is supported in the needle-bar case 27 so as to be movable in the X-direction. Ten needle bars 28 are supported in the needle-bar case 27 in the embodiment as shown in FIGS. 1 and 2.

Coil springs (not shown) are provided in the needle-bar case 27 so as to correspond to the respective needle bars 28. Each needle bar 28 has a lower end protruding downward from a lower end of the needle-bar case 27. An embroidery sewing needle 31 is replaceably mounted on the lower end of each needle bar 28. A presser foot 32 for embroidery sewing is provided below the needle bars 28 so as to be movable in synchronization with the vertical movement of each needle bar 28. A plurality of needle thread take-up levers 33 is provided so as to correspond to the needle bars 28 respectively. The needle-bar case 27 has vertically extending slits 34 formed in the front side thereof. The thread take-up levers 33 have respective distal ends protruding frontward through the slits 34. Each thread take-up lever 33 is vertically movable in synchronization with the vertical movement of the needle bar 28.

The needle-bar case 27 includes an upper cover 38 formed integrally therewith and extends obliquely rearward from the upper end of the needle-bar case 27. The upper cover 38 is provided with a plurality of thread tensioners 37 the number of which corresponds with that of the needle bars 28. The upper cover 38 has an upper end provided with a plurality of thread breakage sensors 38 the number of which corresponds to that of the needle bars 28. Thus, ten thread tensioners 37 and ten thread breakage sensors 38 are provided in the embodiment wherein the ten needle bars 28 are provided. The operator draws needle threads out of thread spools and sequentially passes the needle threads through predetermined passages including the thread breakage sensors 38, the thread tensioners 37, the thread take-up levers 33 and the like, respectively. The needle threads are finally passed through eyes (not shown) of the needles 31. In this case, the needle threads with different colors are supplied to the ten needles 31. The embroidery sewing with the use of needle threads of a plurality of colors is executable while the needle threads being automatically switched continuously.

A sewing machine motor (not shown) is housed in the support pillar 12 in the same manner as in conventional sewing machines. The arm 13 includes a main shaft (not shown) driven by the motor, a needle-bar vertically driving mechanism vertically driving the needle bars 28 by the rotation of the main shaft, and a needle-bar selecting mechanism which moves the needle-bar case 27 in the X-direction thereby to select one of needle bars 28. The thread capturing hook 28 is driven by the main shaft in synchronization with the vertical movement of the needle bar 28. The needle-bar vertical drive mechanism, the needle-bar selecting mechanism and the thread capturing hook are not shown in the drawings since these mechanisms and the hook are well known in the art.

The needle-bar vertical drive mechanism has a vertical movement member selectively engaging a needle bar bracket fixed to each needle bar 28. The needle-bar selecting mechanism moves the needle-bar case 27 in the X-direction with the needle-bar selecting motor serving as a drive source. As the result of movement of the needle-bar case 27, the needle-bar selecting mechanism engages the needle-bar bracket of the needle bar 28 located at the position right above the needle hole 22 with the vertical movement member. A single needle thread take-up lever 33 and the need bar 28 both to be connected to the main shaft are selected by the movement of the needle-bar case 27. The selected needle thread take-up lever 33 is vertically driven in the vertical direction by the needle-bar vertical movement mechanism. The needle-bar case 27 will hereinafter be referred to as "head 63."

The transfer mechanism 15 is provided above the sewing bed 11 in front of the support pillar 12. An embroidery frame (not shown) holding a workpiece cloth to be embroidered is detachably attached to the transfer mechanism 15 when an embroidery sewing is to be executed. A plurality of embroidery frames with different sizes and shapes is prepared according to the size of workpiece cloth or a sewing range.

The transfer mechanism 15 has a Y-direction carriage 41, an X-direction carriage 42 and a frame holder 43. The X-direction carriage 42 is provided on the Y-direction carriage 41. The frame holder 43 is provided on the X-direction carriage 42. The transfer mechanism 15 also has a Y-direction drive mechanism and an X-direction drive mechanism neither shown. The Y-direction drive mechanism is accommodated in the sewing bed 11 and drives the Y-direction carriage 41 in the Y-direction or in the front-back direction. The X-direction drive mechanism is accommodated inside the Y-direction carriage 41 and drives the X-direction carriage 42 and the frame holder 43 in the X-direction or in the horizontal direction. The transfer mechanism 15 freely transfers an embroidery frame on the frame holder 43 in the X-direction and the Y-direction.

The Y-direction carriage 41 is formed into the shape of a box extending in the right-left direction and straddles between the legs 17 and 18 of the sewing bed 11. The legs 17 and 18 have guide grooves 44 extending in upper portions thereof in the front-back direction respectively. The Y-direction drive mechanism has a moving portion 45 vertically extending through the guide groove 44 as shown in FIG. 1. The moving portion 45 is movable in the front-back direction along the guide groove 44. The moving portion 45 has an upper end to which right and left ends of the Y-direction carriage 41 are connected.

The Y-direction drive mechanism is constructed into a rectilinear travel mechanism including a Y-direction drive motor comprising a stepping motor, a timing pulley and a timing belt. The Y-direction carriage 41 moves the moving portion 45 and the Y-direction carriage 41 by the rectilinear travel mechanism with the Y-direction drive motor serving as the drive source. The X-direction carriage 42 includes a part protruding frontward from below the front end side of the Y-direction carriage 41. The X-direction carriage 42 is formed into the shape of a plate extending in the right-left direction and is slid in the X-direction relative to the Y-direction carriage 41. The Y-direction carriage 41 accommodates the X-direction drive mechanism. The X-direction drive mechanism is constructed into a rectilinear travel mechanism including an X-direction drive motor comprising a stepping motor, a timing pulley and a timing belt. The rectilinear travel mechanism with the X-direction drive motor serving as the drive source freely drives the X-direction carriage 42 in the right-left direction.

The auxiliary table 16 will now be described in detail. The auxiliary table 16 is detachably attached to the sewing machine 10 so as to be located above the sewing bed 11 as shown in FIG. 1. The auxiliary table 16 includes a table body 51 and two engaging members 55. The table body 51 has an underside 54 and an upper surface 57 located opposite the underside 54. When the sewing machine 10 has been installed on an installation mounting (not shown), the upper surface 57 and the underside 54 of the table body 51 are directed upward and downward in the direction of gravitational force respectively. The upper surface 57 is adapted to be in parallel to and substantially on a level with the upper surface of the cylinder head 14 when the auxiliary table 16 has been attached to the sewing bed 11, as shown in FIG. 2.

Figure 4:
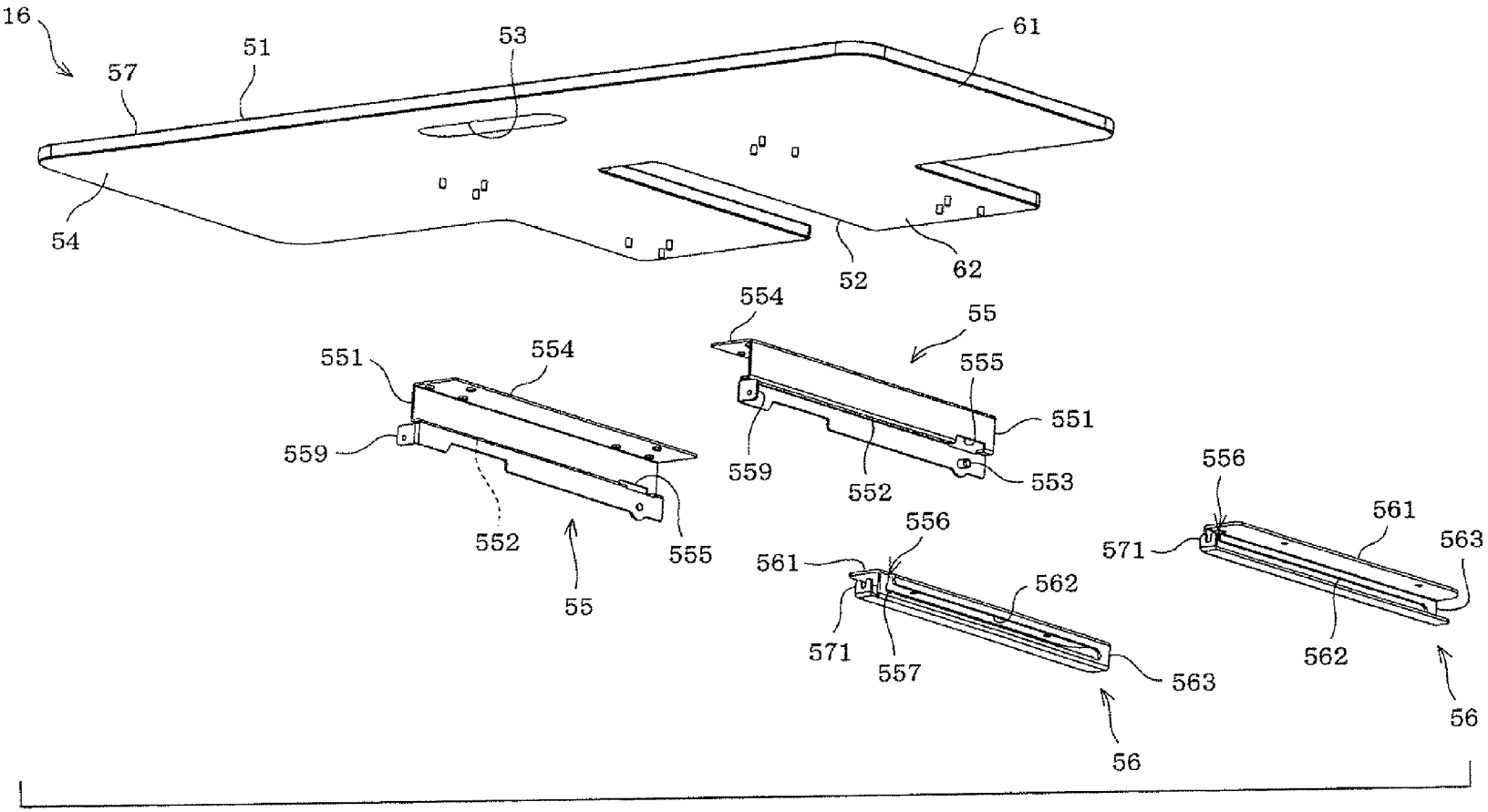
FIG. 4 is an exploded perspective view of an auxiliary table, an engaging portion and a guide member in the first embodiment as viewed from below.

The table body 51 is formed into the shape of a plate formed by a single rectangular portion or the combination of a plurality of the rectangular portions. In the embodiment, the table body 51 has a larger rectangular baseplate 61 and a rectangular insertion portion 62 protruding rearward from the baseplate 61 as shown in FIG. 4. The insertion portion 62 is formed with a notch 52 extending from the rear side to the front side in a horizontally middle portion of the insertion portion 62. The cylinder bed 14 is accommodated in the notch 52 and formed into such a shape as to surround a front end and right and left sides of the cylinder bed 14 as shown in FIG. 2. A rectangular through-hole-like finger-hook hole 53 having rounded corners is formed substantially in the middle front of the table body 51. The operator puts his/her fingers into the finger-hook hole 53 in order to handpick the baseplate 61. The finger-hook hole 53 need not be a through hole but may be a recess. It is desirable that the finger-hook hole 53 be located in the underside 54 when formed into the shape of the recess.

The engaging members 55 are mounted on the underside 54 of the table body 51 as shown in FIGS. 1 and 4. Since the engaging members 55 have the same structure, one of the engaging members 55 will be described. Also, one of two guide members 56 will be described in the following. The engaging member 55 has a plate member 551, a stepped portion 552, a pin 553 and a mounting plate 554. The engaging member 55 is adapted to engage the guide member 56 provided on the sewing bed 11. The plate member 551 of the engaging member 55 extends in the front-back direction of the table body 51 while hanging vertically downward on the underside 54 of the table body 51. The stepped portion 552 of the engaging member 55 is located near the middle in the hanging direction of the plate member 551. The stepped portion 552 is formed into the shape of a plate in parallel to the table body 552 by bending the plate member 551 into a crank shape. The stepped portion 552 serves as a sliding contact portion and is brought into a sliding contact with the guide member 56 when the table body 51 is moved in the front-back direction.

The pin 553 serves as a protrusion and is located below the stepped portion. In the embodiment, the pin 553 is made of a columnar metal and mounted on the plate member 551. The pin 553 protrudes from the plate member 551 to the guide member 56 side. An escape hole 555 is formed so as to be located above the pin 353 by cutting off parts of the plate member 55 and stepped portion 552. The mounting plate 554 is provided on an upper end of the plate member 551 and formed into the shape of a plate in parallel to the underside 54 of the table body 51 by bending an upper end of the plate member 551. Thus, the mounting plate 554 is formed in parallel to the stepped portion 552 and fixed to the underside 54 of the table body 51 using screws (not shown).

Figure 6:
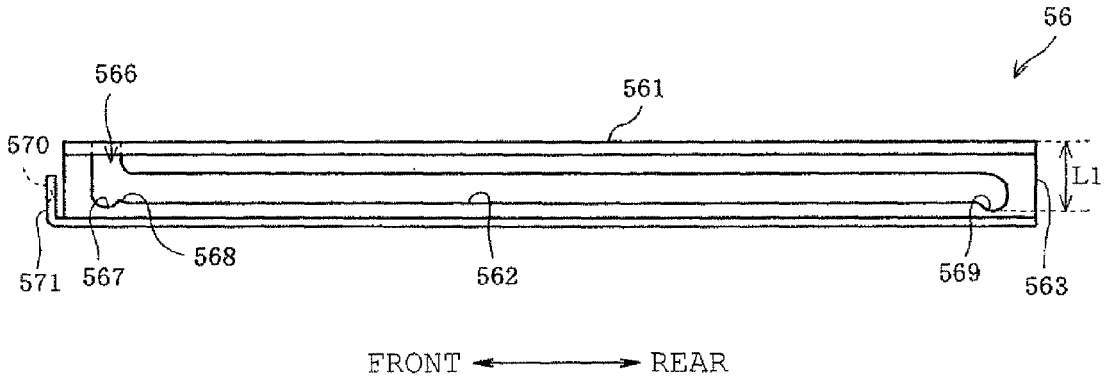
FIG. 6 is a side view of the guide member in the first embodiment as viewed in a side.

The guide member 56 extends in the front-back direction and mounted on an inner upper end of the leg 17 or 18 of the sewing bed 11, as shown in FIG. 1. In this case, the position of the guide member 56 mounted on the leg 17 or 18 corresponds to the engaging member 55 mounted on the auxiliary table 16. The guide member 56 has a bearing portion 561 formed into the shape of a flat plate, and a side plate 563 forming the groove 562 as shown in FIGS. 4 and 6. The guide member 56 is mounted on an inner upper end of the leg 17 or 18 so that the bearing portion 561 is in parallel to an upper surface of the cylinder bed 14.

The side plate 563 is formed into the shape of a plate extending downward from an end of the bearing portion 561. The side plate 563 extends in the front-back direction in the same manner as the bearing portion 561. The side plate 563 has a groove 562 which is formed in the inside thereof extending in the front-back direction. The groove 562 has a vertical width that is slightly larger than a diameter of the pin 553. The pin 553 is movable in the front-back direction along the groove 562 when having been engaged with the groove 562.

The side plate 563 has an open end 566 and a holding portion 567 both provided at the front end side of the groove 562. The open end 566 is formed so that an upper part thereof is open near the front end of the groove 562. The open portion of the open end 566 is formed so as to be slightly larger than the diameter of the pin 553. As a result, the pin 553 can be inserted into and pulled out of the open end.

The holding portion 567 is provided below the open end 566 and connected to the groove 562. Each holding portion 567 is formed into the shape of a circular arc that is slightly larger than a radius of the pin 553 of the engaging member 55. The holding portion 566 has a lowermost end of the arc located lower than the underside of the groove 562. The side plate 563 has a convex portion 568 between the groove 562 and the holding portion 567. The convex portion 568 has an uppermost end protruding slightly higher than the underside of the groove 562. Accordingly, the pin 553 inserted into the open end 566 is lightly held in the front-back direction by the holding portion 567 thereby to be rotatable at this position. The auxiliary table 16 is located at a second position when the pin 553 is located at the holding portion 567.

Figure 5:
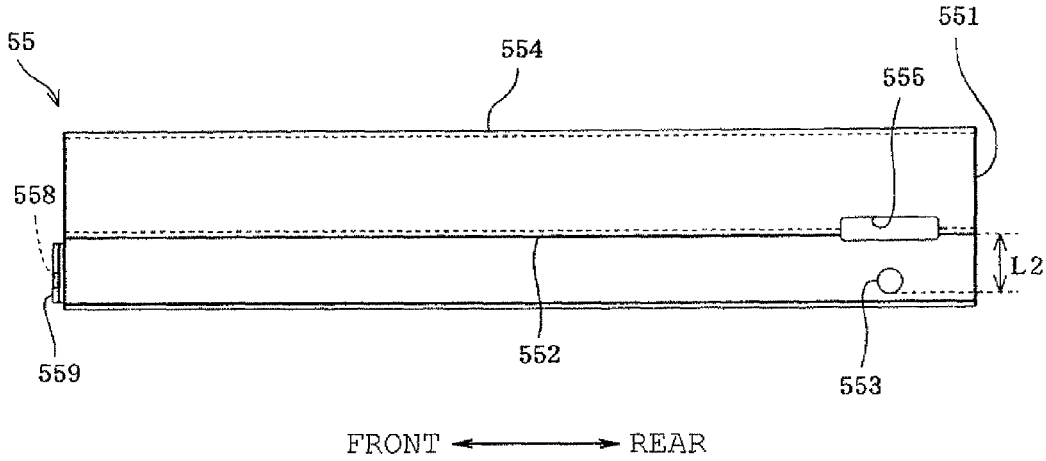
FIG. 5 is a side view of the engaging member in the first embodiment as viewed in a side.

On the other hand, the side plate 563 has a depression 569 in the rear end thereof. The depression 569 is formed so as to be slightly larger than the radius of the pin 553 in the same manner as the holding portion 567. The depression 569 has a lowermost end located lower than the underside of the groove 562. In the embodiment, a distance L1 (see FIG. 6) between the lowermost end of the depression 569 and the upper surface of the bearing portion 561 is set so as to be larger than a distance L2 (see FIG. 5) between the underside of the stepped portion 552 of the engaging member 55 and the lowermost end of the pin 553. Accordingly, the pin 553 is disengaged from the groove 562 when guided to the rear end side of the groove 562. Since the pin 553 is located in the depression 569 at this time, the stepped portion 552 and the bearing portion 561 are brought into a face-to-face contact. The lowermost end of the pin 553 is not in contact with the lowermost end of the depression 569, but a slight gap is defined therebetween. The auxiliary table 16 is located at a first position when the pin 553 is located in the depression 569.

The guide member 56 has a front end formed with a first wall 571, which abuts against a second wall 559 provided on the front end of the engaging member 55 when the auxiliary table 16 is thrust into the rear end side, that is, when the auxiliary table 16 is located at the first position. The first wall 571 is provided with a fixing-screw inserting portion 570 into which a fixing screw 70 (see FIG. 8) serving as a fixing member is inserted. The fixing-screw inserting portion 570 is a generally U-shaped notch into which a screw portion of the fixing screw 70 is disengageably insertable. The fixing-screw inserting portion 570 is located at a position corresponding to a fixing screw hole 558 provided in the second wall 559 of the engaging member 55.

Figure 7A:
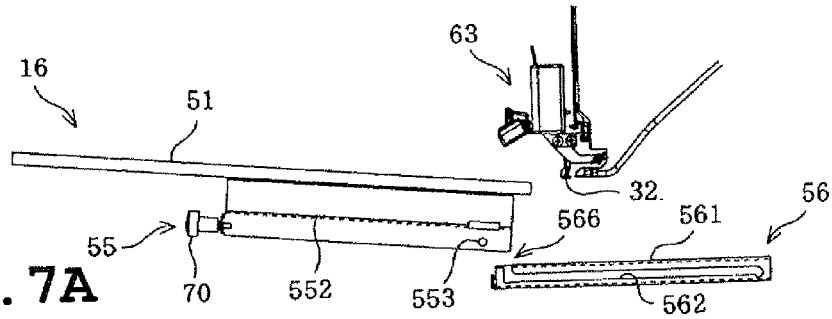
FIGS. 7A to 7E show a procedure for attaching the auxiliary table to a sewing machine bed in the first embodiment.

The above-described sewing machine 10 will work as follows. Firstly, when the auxiliary table 16 is to be mounted to the sewing machine 10, the operator attaches the auxiliary table 16 to the guide member 56 from above as shown in FIG. 7A. FIGS. 7A to 7E show only the related portions of the sewing machine 10 and the auxiliary table 16 for simplification of explanation. The pin 553 of the engaging member 55 is inserted through the open end 566 into the groove 562. Thus, the pin 553 is inserted into the groove 562 from above when the auxiliary table 16 is to be mounted to the sewing machine 10.

Figure 7B:
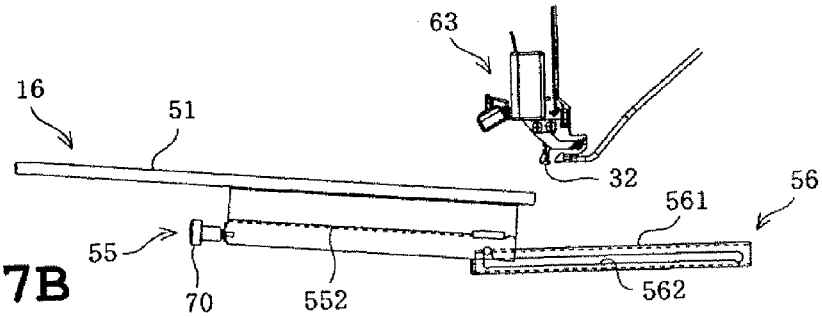
Figure 7C:
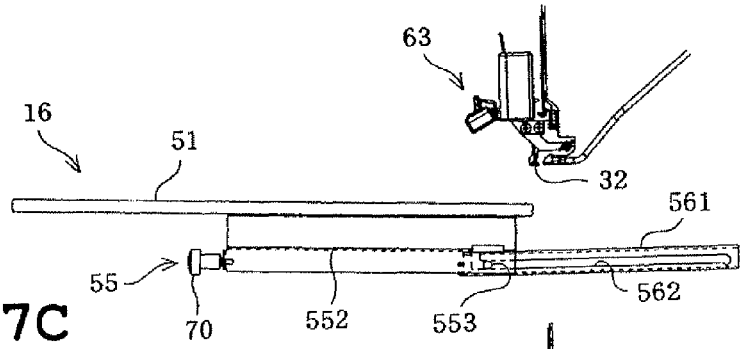

The operator subsequently thrusts the auxiliary table 16 further downward from the state as shown in FIG. 7B. As a result, the pin 553 is lightly held by the holding portion 567. In this case, the auxiliary table 16 is located at the second position as described above. Thereafter, the operator slightly lifts the front (the left part as viewed in FIG. 7C) of the auxiliary table 16 and thrusts the auxiliary table 16 rearward, as shown in FIG. 7C. When the auxiliary table 16 is thrust rearward, the pin 553 gets over the convex portion 568 in moving from the holding portion 567 to the groove 562 side. In this case, the distal portion of the auxiliary table 16 is vertically moved slightly. Accordingly, the operator moving the auxiliary table 16 while gripping the auxiliary table 16 can get a click feeling upon start of the movement of the auxiliary table 16. Consequently, the operator can find that the pin 553 has been moved from the holding portion 567 to the groove 562 side.

The pin 553 of the engaging member 55 is in engagement with the groove 562 during movement of the auxiliary table 16. Since the pin 553 is interposed between the upper and lower surfaces of the groove 56, the vertical movement of the auxiliary table 15 is limited. In this case, when the auxiliary table 16 is to be tilted about the pin 553, the rear end of the stepped portion 552 comes into contact with the upper surface of the bearing portion 561, or the underside of the stepped portion 552 comes into contact with the front end of the bearing portion 561. For example, as shown in FIG. 7C, when the auxiliary table 16 is moved rearward with the front part thereof being slightly lifted, the auxiliary table 16 is moved while the rear end of the stepped portion 552 is in contact with the upper surface of the bearing portion 561. Thus, the auxiliary table 16 cannot be further tilted about the pin 553.

The tilt of the auxiliary table 16 about the pin 553 is limited by the contact between the groove 562 and the pin 553 engaged with the groove 562 and between the stepped portion 552 and the bearing portion 561 during the movement. More specifically, the tilt of the auxiliary table 16 is limited within such an angular range that the auxiliary table 16 is not brought into contact with components provided on the head 63 and located higher than the sewing bed 11.

Figure 7D:
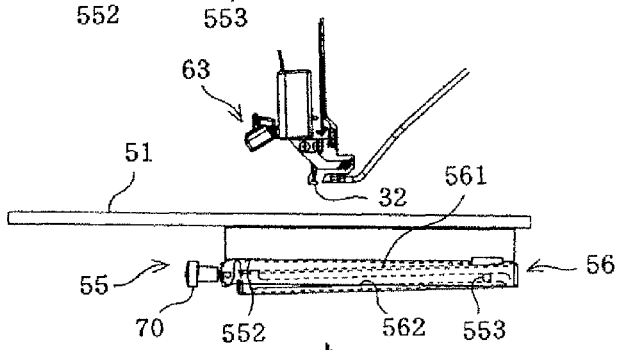
Figure 8A:
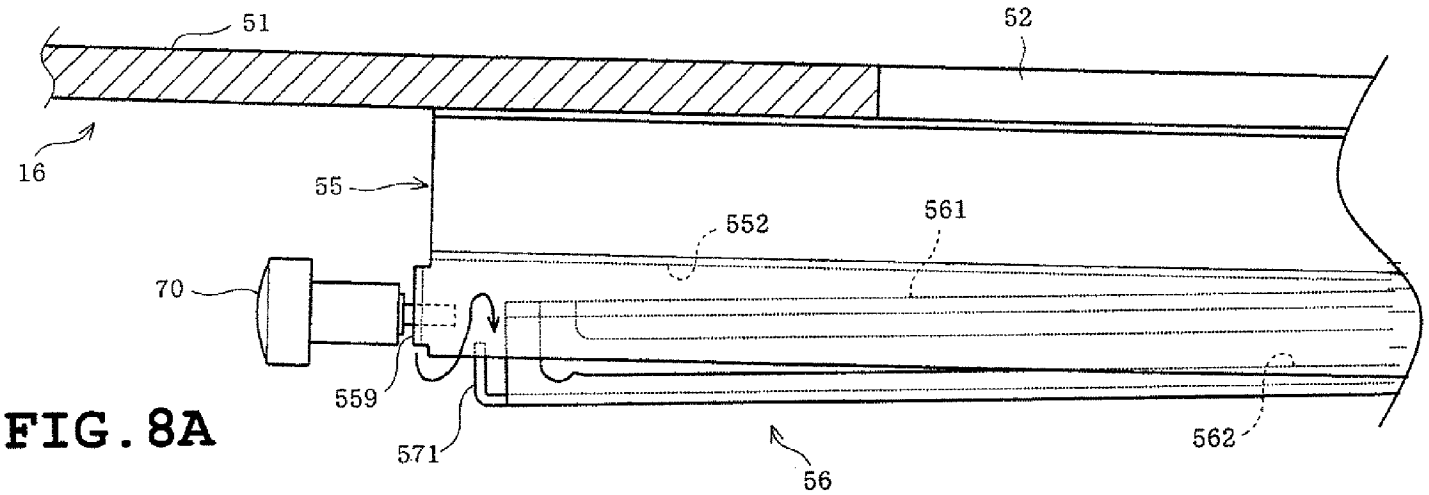
FIGS. 8A and 8B show a procedure for attaching the engaging member to the guide member in the first embodiment.

The operator successively thrusts the auxiliary table 16 near the rear end of the guide member 56 as shown by FIG. 7D. The second wall 559 of the engaging member 55 is moved to the groove 562 side while going over the first wall 571 of the guide member 56, as shown in FIG. 8A. The pin 553 of the engaging member 55 is moved from the groove 56 to the depression 569. In this case, the pin 553 falls from the lower end of the groove 562 into the depression 569, whereupon the operator can get a light click feeling. Accordingly, the operator finds that the auxiliary table 16 has been thrust rearward. In this case, the auxiliary table 16 is located at the first position as described above. Since the upper end of the fixing screw insertion portion 570 formed into the U-shaped notch is open, the second wall 559 of the engaging member 55 gets over the first wall 571 while the temporarily joined fixing screw 70 being mounted. The fixing screw 70 need not be temporarily joined but may be mounted later.

Figure 7E:
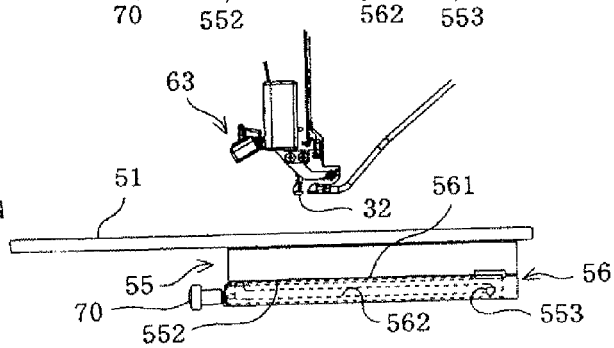
Figure 8B:
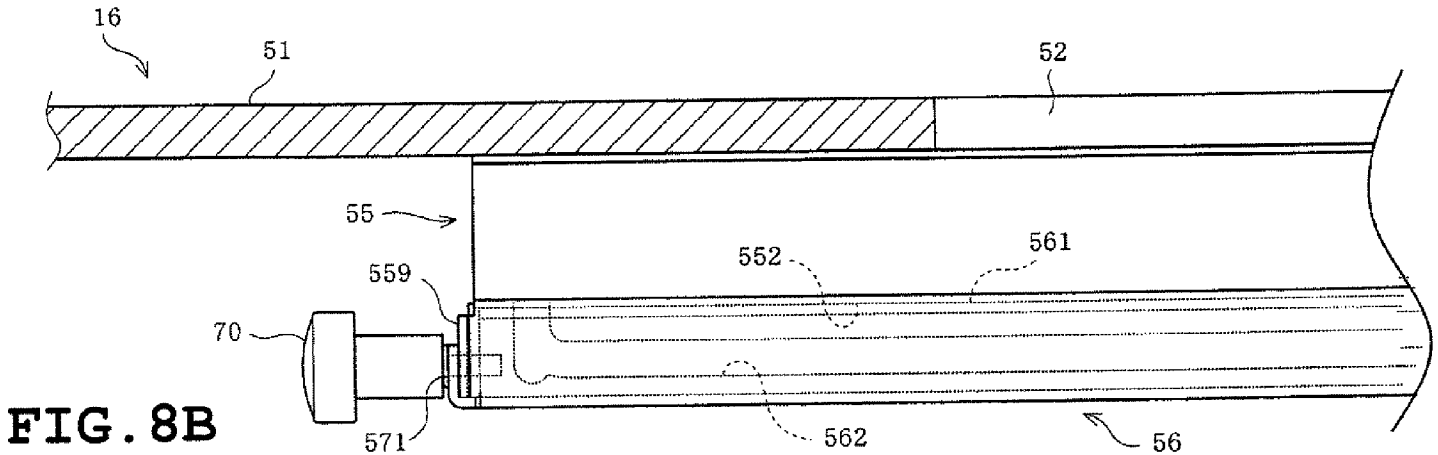

The auxiliary table 16 is then fixed by the fixing screw 70 while the second wall 559 is in abutment with the first wall 571, as shown in FIG. 8B. As a result, the engaging member 55 is fixed to the guide member 56, or in other words, the auxiliary table 16 is immovable in the front-back direction to be fixed at the first position. The pin 553 of the engaging member 55 is in the depression 569 when the auxiliary table 16 is located at the first position, as shown in FIG. 7E. The distance L1 between the depression 569 and the bearing portion 561 is set so as to be larger than the distance L2 between the stepped portion 552 of the engaging member 55 and the pin 553. Accordingly, the pin 553 in the depression 569 is disengaged from the groove 562. Furthermore, the pin 553 is not abutted against the depression 569, that is, load applied to the auxiliary table 16 is not applied to the pin 553.

Furthermore, the underside of the stepped portion 552 of the engaging member 55 is brought into contact with the upper surface of the bearing portion 56 when the pin 553 is in the depression 569. More specifically, the engaging member 55 and the guide member 56 adhere closely to each other. As a result, since the load applied to the auxiliary table 16 is borne by the entire bearing portion 561 but not by the pin 553, the auxiliary table 16 can be supported securely and reliably. Furthermore, the upper surface 57 of the auxiliary table 16 and the upper surface of the cylinder bed 14 can be supported substantially in parallel to each other. Thus, the operator attaches the auxiliary table 16 to the sewing machine 10.

When the auxiliary table 16 is to be detached from sewing machine 10, the fixing screw 70 is loosened or disengaged and thereafter, the front end of the auxiliary table 16 is slightly lifted upward so that the first and second walls 571 and 559 are released from contact therebetween and so that the stepped portion 552 of the engaging member 55 and the bearing portion 561 of the guide member 56 are released from contact therebetween. The auxiliary table 16 is then returned frontward. In this case, when the operator puts his/her fingers into the finger-hook hole 53, the auxiliary table 16 can easily be moved. In this case, furthermore, the auxiliary table 16 is moved frontward with the pin 553 and the groove 562 being engaged with each other. Subsequently, the operator lifts the auxiliary table 16 upward after having returned the auxiliary table 16 frontward or moved the auxiliary table 16 to the second position. Consequently, the pin 553 and the groove 562 are released from the engagement therebetween, and the auxiliary table is detached from the sewing machine 10.

The auxiliary table 16 is moved in a manner similar to attachment of the auxiliary table 16 while the front end of the stepped portion 552 and the upper surface of the bearing portion 561 are in sliding contact with each other. This limits the tilt of the auxiliary table 16 within a predetermined angular range. As a result, the auxiliary table 16 in motion is prevented from collision against the components of the head 63. Furthermore, the pin 553 gets over the convex portion 568 when moving from the groove 562 to the holding portion 567. Consequently, since the operator gets a light click feeling, he/she can easily find that the auxiliary table 16 has been moved to the second position where the auxiliary table 16 is detachable.

Figure 9A:
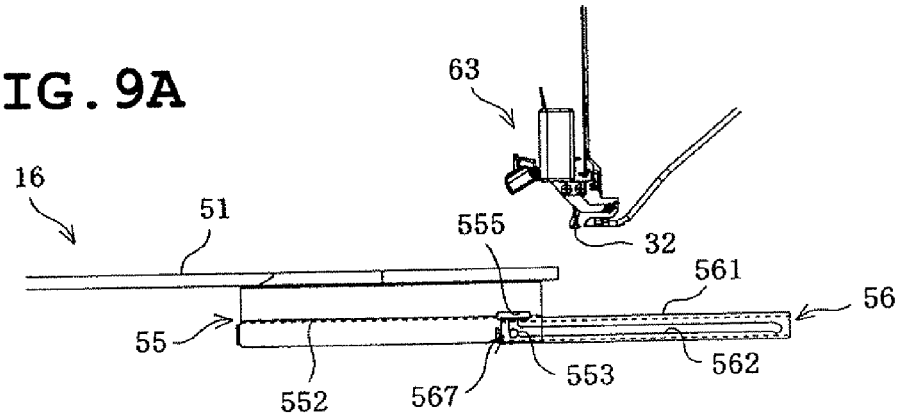
FIGS. 9A to 9C show a procedure for rotating the auxiliary table to a retreat position in the first embodiment.
Figure 9B:
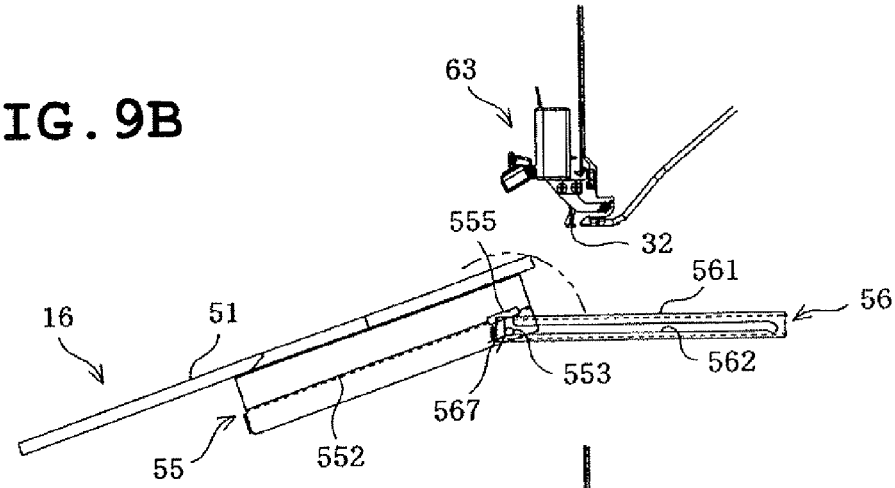
Figure 9C:
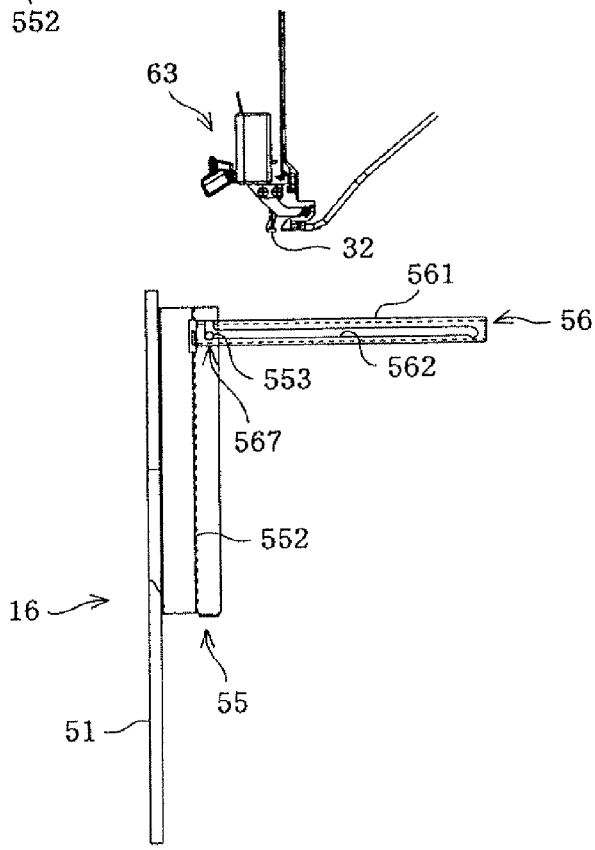

The pin 553 is rotatably held by the holding portion 567 when the auxiliary table 16 is located at the second position, as shown in FIG. 9A. Accordingly, the auxiliary table 16 is turnable about the pin 553 in a forwardly downward direction (in the counterclockwise direction as viewed in a right side view) as shown in FIG. 9B. Since the stepped portion 552 of the pin 553 is provided with the escape hole 555, the bearing portion 561 of the guide member 56 and the stepped portion 552 are not brought into contact with each other even when the auxiliary table 16 is turned. The auxiliary table 16 is turned so as to be substantially perpendicular to the guide member 56 as shown in FIG. 9C. More specifically, FIG. 9C shows the auxiliary table 16 which has been moved to a retreat position set at a side opposite the sewing bed 11. The operator can easily move the auxiliary table 16 between the second position and the retreat position when putting his/her fingers into the finger-hook hole 53 to move the auxiliary table 16.

Figure 10:
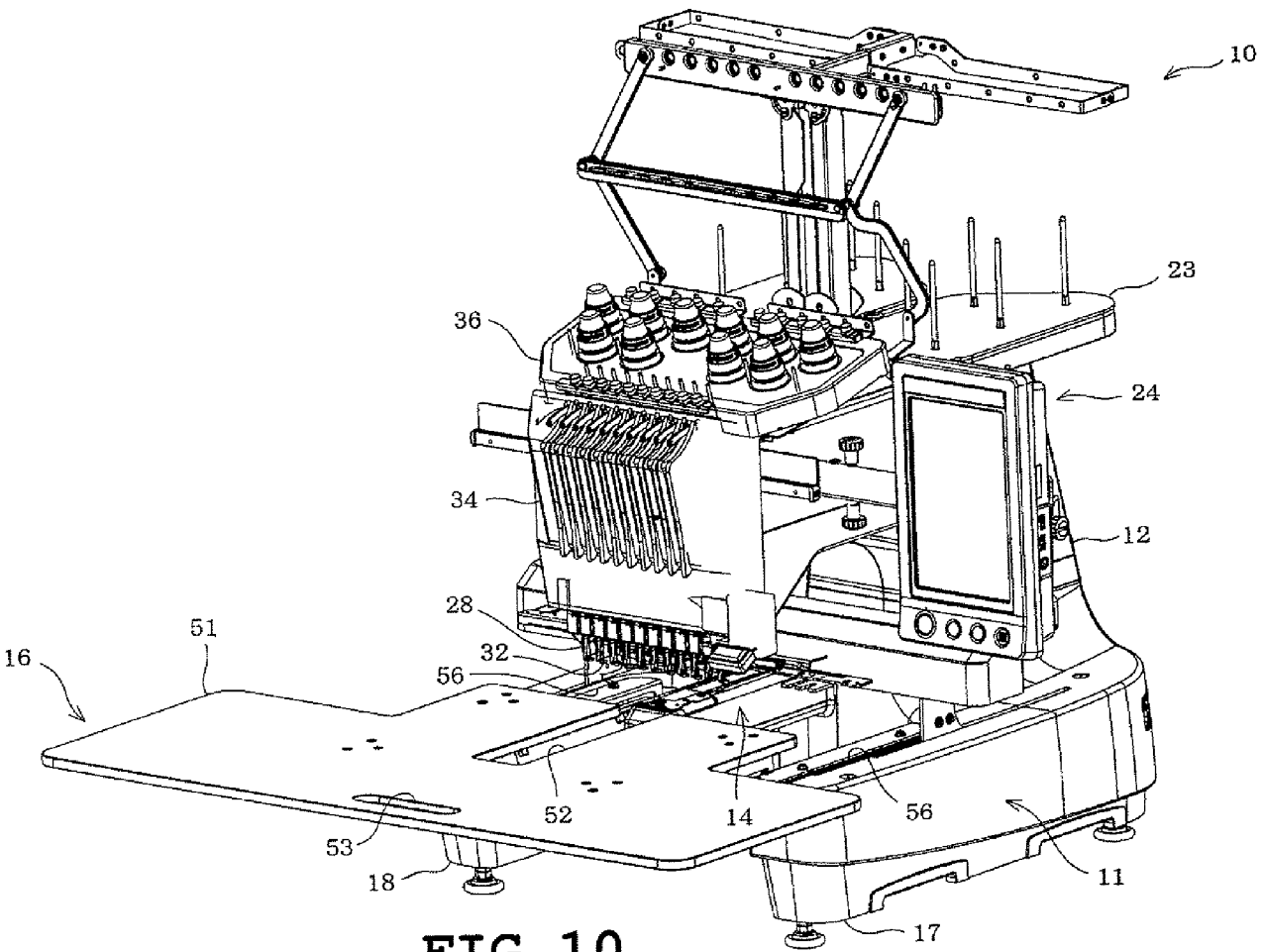
FIG. 10 is a perspective view of the sewing machine in accordance with the first embodiment, showing the state where the auxiliary table is located at a second position.
Figure 11:
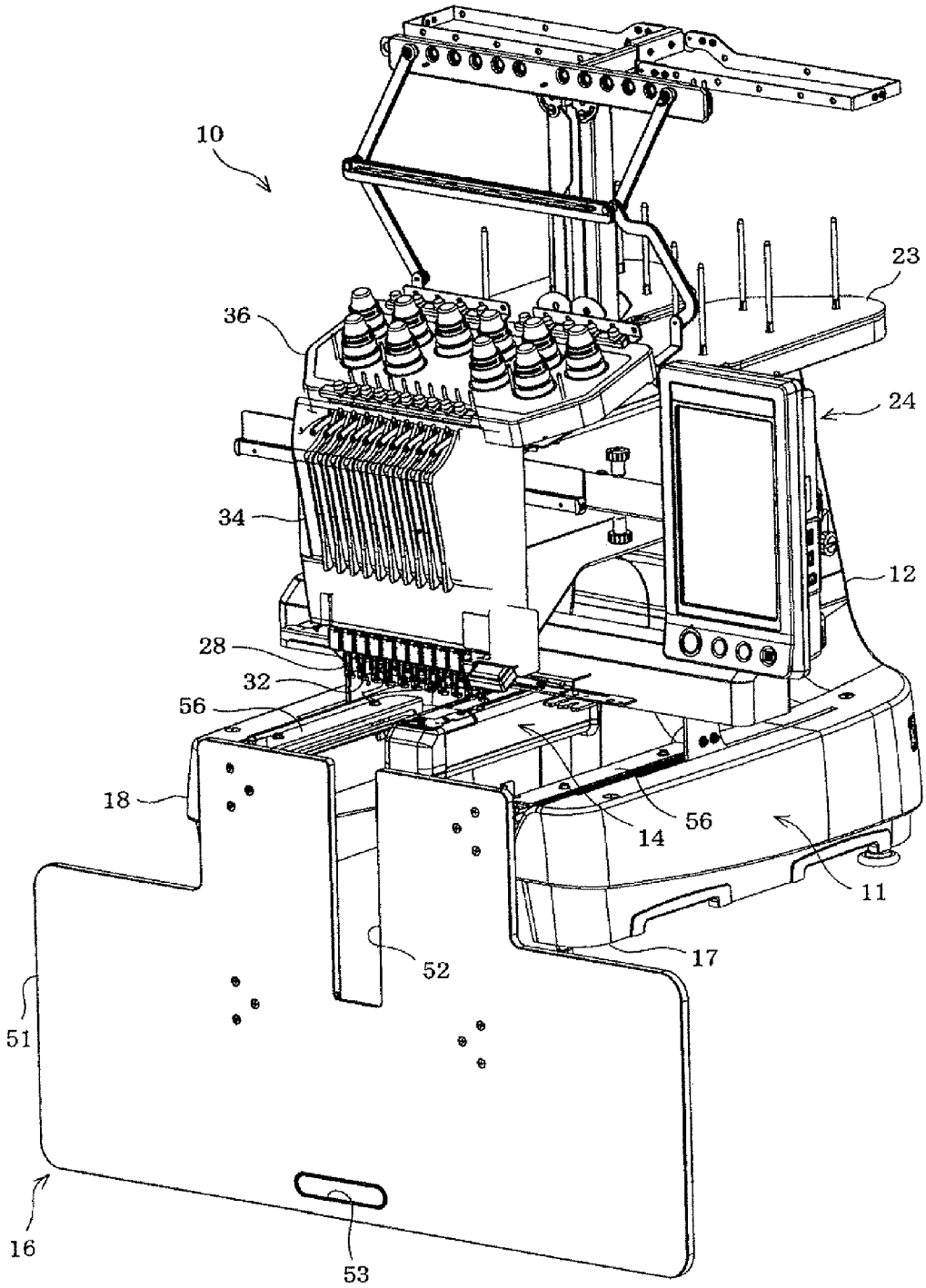
FIG. 11 is a perspective view of the sewing machine in accordance with the first embodiment, showing the state where the auxiliary table has been moved to the retreat position.

In the above-described sewing machine 10, the auxiliary table 16 may be detached from the sewing machine 10 when the auxiliary table 16 is located at the second position as shown in FIGS. 9A and 10. Alternatively, the auxiliary table 16 may be moved to the retreat position as shown in FIGS. 9C and 11. Thus, the operator can suitably select the position of the auxiliary table 16 according to a sewing work.

The sewing machine 10 as described above can achieve the following effects. The auxiliary table 16 is attached to and detached from the sewing machine 10 when located at the first position. When located at the second position, the auxiliary table 16 is held in parallel to the upper surface of the sewing bed 11. When attached to the sewing machine 10, the auxiliary table 16 is guided between the first and second positions by the engagement of the engaging member 55 and the guide member 56. Accordingly, the auxiliary table 16 can easily be moved.

When the auxiliary table 16 is moved between the first and second positions, the tilt of the upper surface 57 of the auxiliary table 16 to the upper surface of the sewing bed 11 is limited within a predetermined angular range by the engagement of the pin 553 of the engaging member 55 and the groove 562 of the guide member 56 and the contact of the stepped portion 552 and the bearing portion 561. Accordingly, when moved relative to the sewing bed 11, the auxiliary table 16 can be prevented from collision against the components provided on the head 63 such as the sewing needle 31 and the embroidery presser foot 32.

The auxiliary table 16 is guided by the engagement of the pin 553 of the engaging member 55 and the groove 562 of the guide member 56 so as to be movable between the first and second positions. As a result, the auxiliary table can be guided by a simple structure. Furthermore, a guide mechanism for moving the auxiliary table 16 can be provided in a simple structure at low costs.

The guide member 56 has the open end 566 having the upper opening through which the pin 553 of the engaging member 55 is inserted into or pulled out of the groove 562. The auxiliary table 16 is attached to or detached from the groove 562 through the upper open end 566 when the pin 553 is inserted into or pulled out of the groove 562, that is, when the auxiliary table 16 is attached to or detached from the sewing machine 10 at the second position. Accordingly, when the auxiliary table 16 is attached to the sewing bed 11, the pin 553 can easily be inserted into the groove 562. When the auxiliary table 16 is detached from the sewing bed 11, there is no possibility that the auxiliary table 16 may fall downward, since the open end 566 is directed upward. As a result, the auxiliary table 16 can easily be handled in the attachment to the sewing machine 10.

The pin 553 is rotatably held on the holding portion 567 when the auxiliary table 16 is located at the second position. As a result, the auxiliary table 16 can easily be turned smoothly to the retreat position that is set so as to be located opposite the sewing bed 11. Furthermore, the pin 553 of the engaging member 55 falls into the depression 569 thereby to be disengaged from the groove 562 when the auxiliary table 16 is located at the first position. The underside of the stepped portion 552 of the engaging member 55 adheres closely to the upper surface of the bearing portion 561 of the guide member 56. Accordingly, since the load applied to the auxiliary table 16 is borne by the entire bearing portion 561 but not by the pin 553, the auxiliary table 16 can be supported securely and reliably.

The operator can get a click feeling when the pin 553 is moved between the groove 562 and the depression 569. Consequently, the operator can find that the auxiliary table 16 has been moved to the first position. Furthermore, the pin 553 of the engaging member 55 gets over the convex portion 568 when moved between the holding portion 567 and the groove 562. Accordingly, the operator can get a click feeling when the auxiliary table 16 is moved. Consequently, the operator can find that the auxiliary table 16 has been moved to the second position.

The first wall 571 of the guide member 56 and the second wall 559 of the engaging member 55 are fixed together by the fixing screw 70 when the auxiliary table 16 is located at the first position. As a result, the auxiliary table 16 can reliably be fixed, and the auxiliary table 16 can be prevented from shaking during sewing, for example. Additionally, since the notch 52 is provided in the table body 51 of the auxiliary table 16, the auxiliary table 16 can be fit with the configuration of the cylinder bed 14 thereby to be attached to the sewing machine 10 even when the auxiliary table 16 has been moved to the first position.

Figure 12:
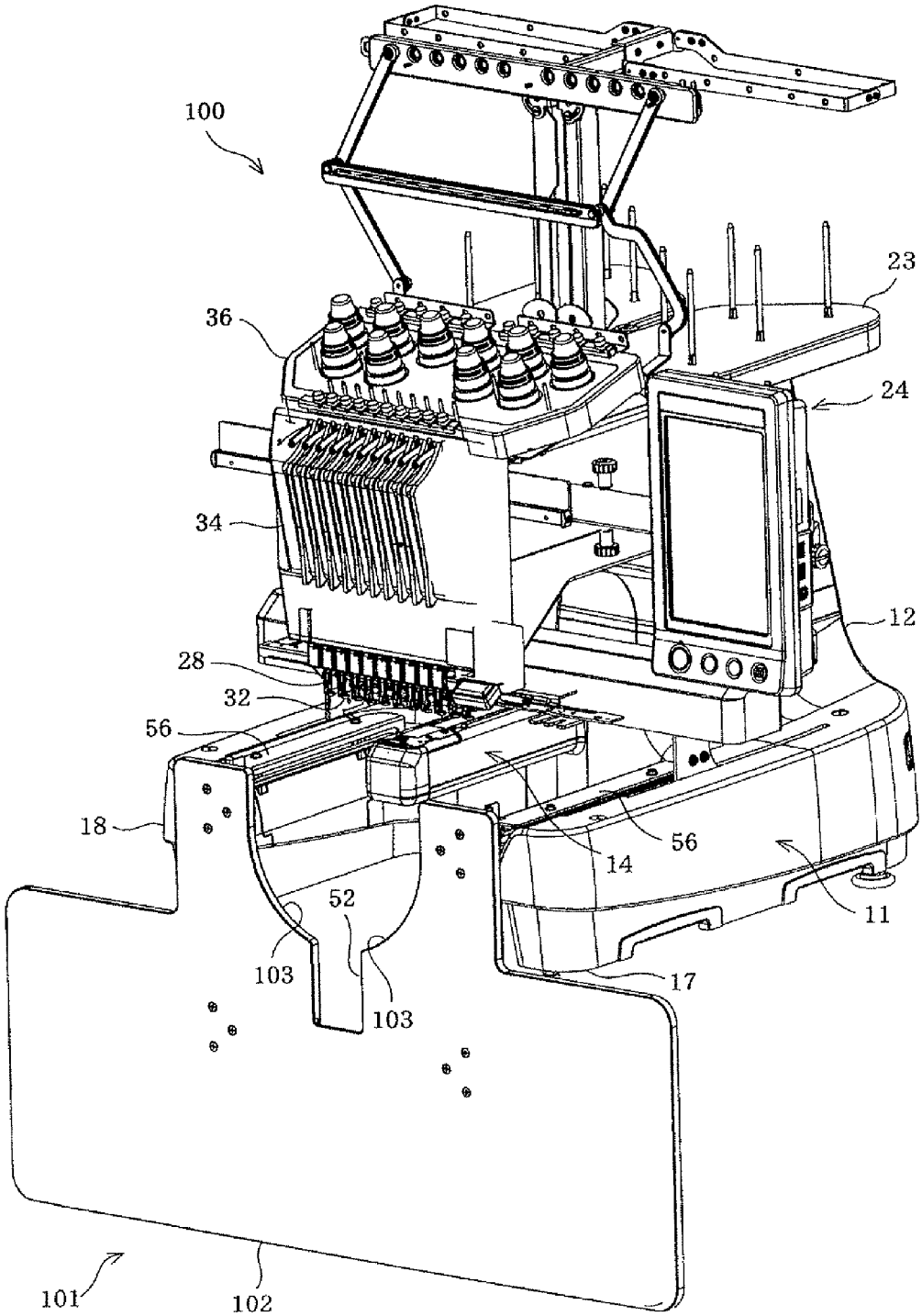
FIG. 12 is a perspective view of the sewing machine in accordance with a second embodiment, showing the state where the auxiliary table has been moved to the retreat position.
Figure 13:
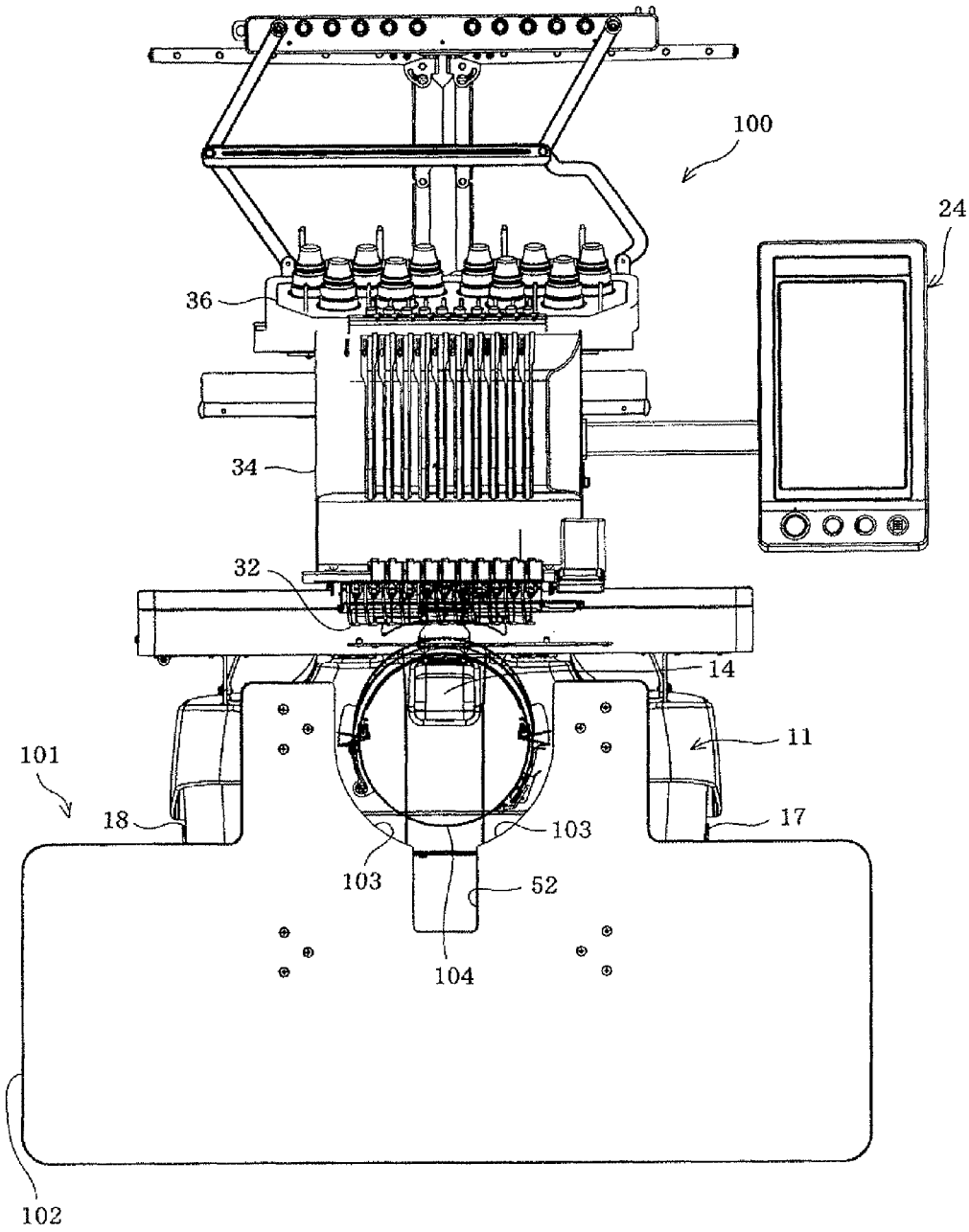
FIG. 13 is a front view of the sewing machine to which an attachment member is attached, in the second embodiment.

FIGS. 12 and 13 illustrate a second embodiment. The sewing machine in accordance with the second embodiment differs from the first embodiment only in the shape of the table body of the auxiliary table. The sewing machine 100 in accordance with the second embodiment is provided with the auxiliary table 101. The auxiliary table 101 has an escape portion 103 which is continuous to the notch 52 formed in the rear end side of the table body 102, as shown in FIG. 12. The escape portion 103 is formed into the shape of an arc spread toward the outside of the table body 102. In the embodiment, the escape portion 103 has an inner peripheral side width that is set so as to be larger than an outer configuration of an attachment 104, such as a cap frame or a cylindrical frame, which is used for embroidery sewing of caps and stereoscopic cylindrical workpieces. Since the cap frame and cylindrical frame are well known in the art, description of these frames will be eliminated. The attachment 104 is attached so as to surround the cylinder bed 14.

A space larger than the outer configuration of the attachment 104 is defined between the escape portion 103 and the cylinder bed 14 when the auxiliary table 101 is moved to the retreat position, as shown in FIG. 13. The attachment 104 can be attached to the cylinder bed 14 from the front side of the sewing machine 105 as the result of provision of the escape portion 103 in the auxiliary table 101.

In the sewing machine 100 in accordance with the second embodiment, the attachment 104 can be attached to or detached from the sewing machine 100 even when the auxiliary table 101 has been attached to the sewing bed 11. Accordingly, the working efficiency can be improved in the case where a sewing work with the use of the attachment 104 is executed.

The cylinder bed 14 is accommodated in the notch 52 and the escape portion 103 when the auxiliary table 101 has been moved to the first position. As a result, the auxiliary table 101 can be used even when a planar workpiece cloth is sewn. The engaging member 55 is provided at the side of the underside of the auxiliary table 101, and the guide member 56 is provided on the sewing bed 11. Consequently, the auxiliary table 101 can be moved while the tilt thereof is limited to the predetermined angular range. Thus, the second embodiment can achieve the same effects as the first embodiment.

The above-described embodiments should not be restrictive but may be modified or expanded without departing from the gist. For example, the embodiments may be modified or expanded as follows. Although the protrusion comprises the pin 553 in the foregoing embodiments, the shape of the protrusion should not be limited to that of the pin 553. For example, the protrusion may have the shape of a circular cone, triangular pyramid, square pyramid or the like. Alternatively, the protrusion may be formed by folding a part of the front end of the plate member 551 toward the guide member 56.

Although the pin 553 is provided on the engaging member 55 and the groove 562 is provided in the guide member 56 in the foregoing embodiments, the groove may be provided in the engaging member 55 and the protrusion may be provided on the guide member 56, instead. More specifically, each of the engaging member 55 and the guide member 56 may be constructed into any structure if the auxiliary table 16 can be guided between the first and second positions while the tilt thereof is limited.

The shape of the convex portion 568 may be suitably changeable. More specifically, the convex portion 568 may take any shape if the operator can find that the pin 553 of the engaging member 55 has been moved between the holding portion 567 and the groove 562.

Although the arc-shaped escape portion 103 is provided in the second embodiment, the shape of the escape portion 103 should not be limited to the above-described one. For example, the escape portion may be rectangular in shape, instead. Thus, the escape portion may take any shape that allows the attachment to be attached to and detached from the cylinder head when the auxiliary table 101 has been moved to the retreat position.

The foregoing description and drawings are merely illustrative of the principles of the present disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. A sewing machine comprising:

a sewing machine bed having an upper surface;

a generally flat-plate-shaped auxiliary table which is detachably attachable to the sewing machine bed;

a guide member which is provided on the sewing machine bed and guides the auxiliary table between a first position which is set at a rear side of the sewing machine bed and where the auxiliary table is held in parallel to the upper surface of the sewing machine bed and a second position which is set at a front side of the sewing machine bed and where the auxiliary table is attached to and detached from the sewing machine bed; and an engaging member which is provided on the auxiliary table so as to movably engage the guide member, wherein the guide member and the engaging member are engaged with each other, whereby a tilt of the auxiliary table to the upper surface of the sewing machine bed is limited within a predetermined angular range when the auxiliary table is positioned between the first and second positions;

the guide member has a generally flat-plate-shaped bearing portion which is provided in parallel to the upper surface of the sewing machine bed and extends from the first position to the second position, and a side plate which extends below the bearing portion in a front-back direction and has a groove guiding the engaging member from the first position to the second position; and the engaging member has a sliding contact portion which is brought into sliding contact with the bearing portion and a protrusion which is inserted into the groove.

2. The sewing machine according to claim 1, wherein the guide member has an open end through which the protrusion is inserted into and pulled out of the groove and which is connected to a part of the guide member located above the groove and has an open upper end, and a holding portion which holds the protrusion inserted through the open end of the guide member so that the protrusion is rotatable, and the auxiliary table is rotatable to a retreat position set at a side opposite the sewing machine bed about the protrusion held by the holding portion when located at the second position.

3. The sewing machine according to claim 1, wherein the guide member has a downward recess which is provided so that the protrusion is prevented from abutting against the groove in order that an underside of the sliding contact portion may adhere closely to an upper surface of the bearing portion when the auxiliary table is located at the first position.

4. The sewing machine according to claim 2, wherein the guide member is located between the holding portion and the groove and has a convex portion protruding inside the groove.

5. The sewing machine according to claim 2, wherein the sewing machine bed has a free arm portion in which a hook member is accommodated, and the auxiliary table has a notch into which the free arm portion is inserted and an escape portion into which an attachment member detachably attachable to the free arm portion is inserted when located at the retreat position.

6. The sewing machine according to claim 1, further comprising a fixing member which fixes a first wall provided on a front end of the guide member and a second wall provided on a front end of the engaging member when the auxiliary table is located at the first position.

7. A sewing machine comprising:

a sewing machine bed having an upper surface and extending in a front-back direction of the sewing machine;

a generally flat-plate-shaped auxiliary table which is detachably attachable to the sewing machine bed;

a pair of guide members which are provided on the sewing machine bed so as to extend in parallel with the upper surface of the sewing machine bed; and a pair of engaging members which are provided on the auxiliary table so as to extend in parallel with an upper surface of the auxiliary table and the guide members, the engaging members being movably engaged with the guide members respectively, so that the auxiliary table is movable between a rear first position where the auxiliary table is attachable to the sewing machine bed and a front second position where the auxiliary table is detachable from the sewing machine bed;

wherein the guide members limit tilts of the engaging members and the auxiliary table when the auxiliary table is located between the first and second positions.

8. The sewing machine according to claim 7, further comprising a fixing member which is configured to fix the engaging members to the guide members respectively when the auxiliary table is located at the first position.

* * * * *